United States Patent [19]

Usui et al.

[11] 3,930,671

[45] Jan. 6, 1976

[54] COLOR FORMER AND PRESSURE-SENSITIVE COPYING PAPER

[75] Inventors: Hideo Usui; Sadao Ishige; Teruo Kobayashi, all of Minami-ashigara; Keiso Saeki, Fujimiya, all of Japan

[73] Assignee: Fuji Photo Film Co., Ltd., Minami-ashigara, Japan

[22] Filed: Apr. 17, 1974

[21] Appl. No.: 461,769

[30] Foreign Application Priority Data

Apr. 19, 1973 Japan ..... 48-44403

[52] U.S. Cl. ..... 282/27.5; 260/247.1 P; 260/330.5; 260/293.53; 260/293.57; 427/151; 427/152; 428/411; 428/323

[51] Int. Cl.[2] ..... B41M 5/16

[58] Field of Search ..... 117/36.2, 36.7, 36.8, 36.9; 260/329 F, 330.5, 332.2 H, 332.3 H, 332.3 P

[56] References Cited

UNITED STATES PATENTS

| | | | |
|---|---|---|---|
| 3,331,854 | 7/1967 | Huffman et al. | 260/330.5 |
| 3,619,238 | 11/1971 | Kimara et al. | 117/36.2 |
| 3,849,164 | 11/1974 | Schwab et al. | 117/36.8 |

*Primary Examiner*—P. E. Willis, Jr.
*Attorney, Agent, or Firm*—Sughrue, Rothwell, Mion, Zinn & Macpeak

[57] ABSTRACT

A 1,3-dihydro-1-oxo-benzo[b]thieno[2,3-C]furan derivative represented by the following General Formula I

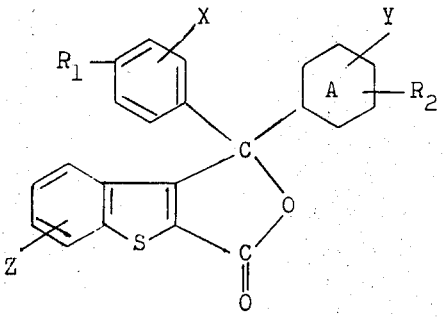

(I)

or a 1,3-dihydro-3-oxo-benzo[b]thieno[2,3-C]furan derivative represented by the following General Formula II:

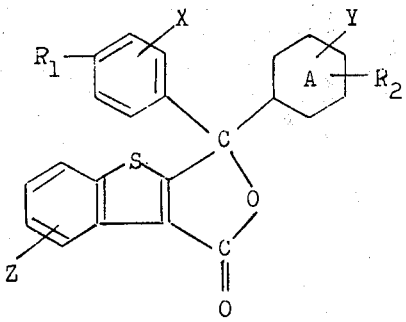

(II)

wherein ring A represents a benzene ring or a naphthalene ring, $R_1$ and $R_2$ each represents an amino group, and X, Y and Z each represents a hydrogen atom, a halogen atom, an alkyl group, an aralkyl group, an alkoxy group, an aralkoxy group, an acyloxy group, a nitro group or an amino group, useful as a color former, e.g., in a pressure sensitive copying paper.

6 Claims, No Drawings

COLOR FORMER AND PRESSURE-SENSITIVE COPYING PAPER

BACKGROUND OF THE INVENTION

1. Field of the Invention

The present invention relates to a pressure-sensitive copying paper and, more particularly, it relates to a pressure-sensitive copying paper wherein a novel color former is used.

2. Description of the Prior Art

In general, pressure-sensitive copying papers utilizing the color reaction between substantially colorless organic compound (hereinafter referred to as a color former) such as Malachite Green lactone, benzoyl leucomethylene blue, Crystal Violet lactone, Rhodamine B lactam, 3-substituted amino-7-substituted aminofluoran, 3-methyl-2,2-spirobi(benzo[f]chromene) or the mixture thereof and an adsorptive or reactive compound capable of developing color when brought into contact with the color former (hereinafter referred to as a color developer) such as a clay mineral (e.g., acid clay, activated clay, attapulgite, zeolite, bentonite, kaolin, etc.), an organic acid (e.g., succinic acid, tannic acid, gallic acid, phenolic compound, etc.) or an acidic polymer (e.g., phenolformaldehyde resin, etc.) as well known (e.g., as disclosed in U.S. Pat. Nos. 2,505,470, 2,505,471, 2,505,489, 2,548,366, 2,712,507, 2,730,456, 2,730,457, 3,418,250, 3,501,331, 3,669,711, 3,427,180, 3,455,721, 3,516,845, 3,634,121, 3,672,935, and 3,732,120).

In the present invention, the color former and the color developer are defined as follows from the viewpoint of electronic theory. That is, the color former is a substance capable of being colored when donating electrons or accepting protons, whereas the color developer is a substance which accepts electrons or donates protons.

A color former of a pressure-sensitive copying paper must possess a rapid coloring rate and show high color density, and the colored dye must possess a desired hue and be excellent in light resistance and heat resistance. As a color former which is colored blue to green, Malachite Green lactone (3,3-bis(p-dimethylaminophenyl)phthalide) is heretofore known. However, this color former has the defect that, since its lactone ring is not opened even when brought into contact with a color developer, the coloring rate thereof is slow and the color density is low. Thus, improvement in the color former has been desired.

It is, therefore, an object of the present invention to provide a pressure-sensitive copying paper which is capable of forming a colored image having a high color density with a rapid coloring rate.

Another object of the present invention is to provide a pressure-sensitive copying paper which is capable of forming a color image excellent in light resistance and heat resistance.

A further object of the present invention is to provide a pressure-sensitive copying paper which is capable of being colored blue to green.

Still a further object of the present invention is to provide a pressure-sensitive copying paper which is capable of being colored various hues.

Also an object of this invention is to provide a 1,3-dihydro-(1-oxo or 3-oxo)-benzo[b]thieno[2,3-C]furan derivative, useful as a color former.

SUMMARY OF THE INVENTION

As a result of extensive investigations to attain the above-described objects, the inventors have found a pressure-sensitive copying paper comprising a support having thereon a color former layer containing 1,3-dihydro-1-oxo-benzo[b]thieno[2,3-C]furan derivative represented by the following General Formula I:

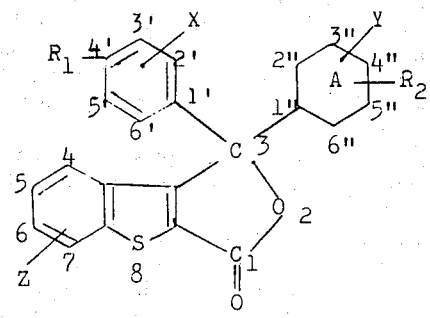

(I)

or a 1,3-dihydro-3-oxo-benzo[b]thieno[2,3-C]furan derivative of the following General Formula II:

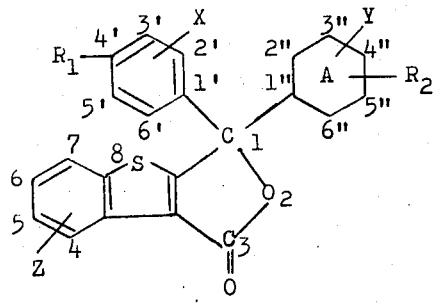

(II)

wherein ring A represents a benzene ring or a naphthalene ring, $R_1$ and $R_2$ each represents an unsubstituted or substituted amino group, X, Y and Z each represents a hydrogen atom, a halogen atom, an alkyl group, an aralkyl group, an alkoxy group, an aralkoxy group, an acyloxy group, a nitro group or an unsubstituted or substituted amino group.

DETAILED DESCRIPTION OF THE INVENTION

Suitable examples of substituents for the substituted amino group represented by $R_1$ and $R_2$ include an alkyl group (e.g., substituted and unsubstituted alkyl groups such as methyl, ethyl, propyl, butyl, chloromethyl, chloroethyl, bromomethyl, bromoethyl, iodomethyl, iodoethyl, cyanomethyl, cyanoethyl, cyanopropyl, cyanobutyl, methoxyethyl, ethoxyethyl, etc.), an aralkyl group (e.g., benzyl, chlorobenzyl, bromobenzyl, methylbenzyl, ethylbenzyl, phenethyl, chlorophenethyl, bromophenethyl, methylphenethyl, ethylphenethyl, etc.), an aryl group (phenyl, chlorophenyl, bromophenyl, tolyl, ethylphenyl, naphthyl, chloronaphthyl, bromonaphthyl, methylnaphthyl, ethylnaphthyl, etc.), an acyl group (e.g., acetyl, benzoyl, phenacyl, etc.), an alicyclic group (e.g., cyclohexyl, etc.) and a heterocyclic group (e.g., morpholino, piperidino, julolidino, etc.).

For X, Y and Z suitable examples of halogen atoms are chlorine, bromine and iodine, examples of alkyl groups are those alkyl groups above described for $R_1$ and $R_2$ and having 1 to 4 carbon atoms, examples of aralkyl groups are those aralkyl groups having 1 to 4 carbon atoms in the alkyl moiety thereof as above described and including phenyl and naphthyl groups as examples of the aryl moiety thereof, examples of alkoxy groups are those having 1 to 4 carbon atoms in the alkyl moiety thereof as above described, examples of aralkoxy groups are those having 1 to 4 carbon atoms in the alkyl moiety thereof as above described and including phenyl and naphthyl groups as examples of the aryl moiety thereof, examples of acyloxy groups are those such as aliphatic acyloxy groups having 1 to 4 carbon atoms in the alkyl moiety thereof as above described and aromatic acyloxy groups including phenyl and naphthyl groups as examples of the aryl moiety thereof, and examples of substituted amino groups are the same as those previously described for $R_1$ and $R_2$.

The pressure-sensitive copying paper of the present invention can take various forms as described in, e.g., the aforesaid preceding patents. That is, the pressure-sensitive copying paper can be prepared by dissolving the above-described color formers, alone, in combination or together with other color formers, in a solvent (e.g., a synthetic oil such as an alkylated naphthalene, an alkylated diphenyl, an alkylated diphenylmethane, an alkylated terphenyl, etc., a vegetable oil such as cotton seed oil, castor oil, etc., an animal oil, a mineral oil or a mixture thereof as described in U.S. Pat. application Ser. No. 174,518, filed Aug. 24, 1971, Ser. No. 172,593, filed Aug. 17, 1971, Ser. No. 193,151, filed Oct. 27, 1971 and Ser. No. 193,152, filed Oct. 27, 1971) at a color former concentration of about 0.01 to 15 wt%, preferably 0.1 to 10 wt %, and more preferably 0.5 to 5 wt %, dispersing the resulting solution in a binder or encapsulating it in microcapsules, and applying it to a support such as a paper, a plastic sheet, a resin-coated paper or the like.

The amount of the color former used is not particularly limited since it varies depending upon the desired coated amount, form of the pressure-sensitive copying paper, process for the production of microcapsules and like conditions. However, it is easy for those skilled in the art to determine the amount.

In the case of encapsulating the color former in microcapsules, the method utilizing coacervation of hydrophilic colloids described in U.S. Pat. Nos. 2,800,457 and 2,800,458, the method of interfacial polymerization described in British Pat. Nos. 867,797, 950,443 and 1,091,076, or a like method can be employed.

The color former of the present invention is a novel compound not described in the art. It can be obtained as schematically illustrated below by, e.g., condensing benzothiophenedicarboxylic acid anhydride (General Formula III) with an aniline derivative (General Formula IV), and condensing the resulting intermediates (General Formulae V and VI) with an aniline derivative or an $\alpha$-naphthylamine derivative represented by the following General Formula VII, followed by neutralization with an alkali aqueous solution.

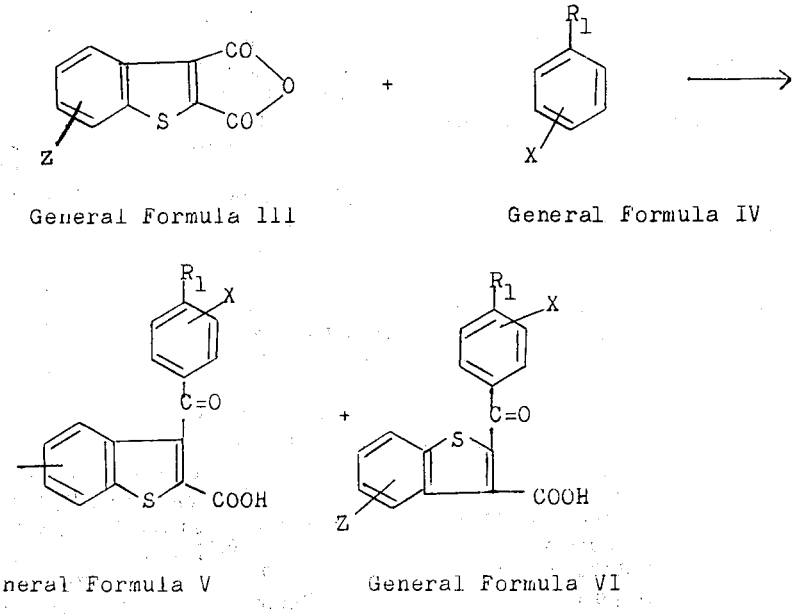

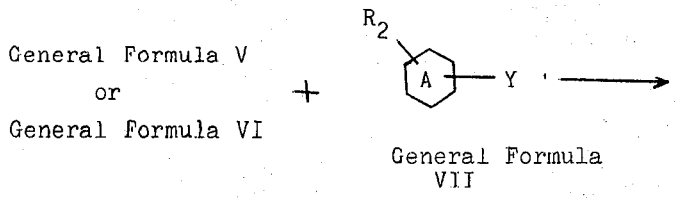

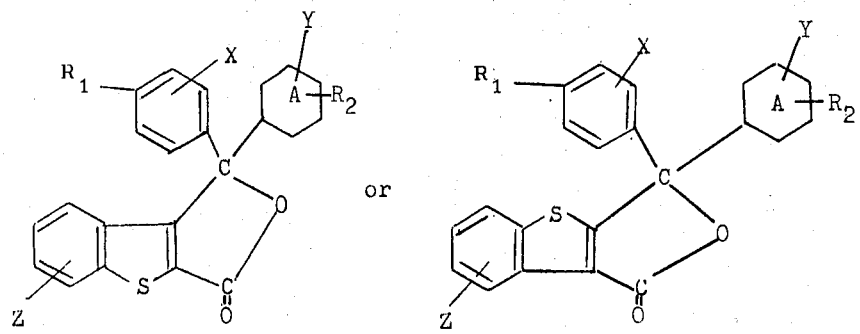

General Formula I or General Formula II wherein A, $R_1$, $R_2$, X, Y and Z are as hereinbefore described.

A suitable reaction temperature for the reaction of the compound of the General Formula III with the compound of the General Formula IV can range from about 50°C to about 200°C, preferably 70°C to 160°C with a suitable molar ratio of 1:1 of the compound of the General Formula III to the compound of the General Formula IV, preferably an excess of the compound of the General Formula III up to a molar ratio of about 1:3 of the compound of the General Formula III to the compound of the General Formula IV. This reaction can be suitably conducted in the presence or absence of a solvent. Where a solvent is employed, a solvent which does not dissolve a Friedel-Crafts catalyst is preferred. Suitable examples of solvents are halogenated alkyls such as ethylene chloride, trichloroethane and tetrachloroethane.

In the reaction of the compound of the General Formula V or VI with the compound of the General Formula VII, suitable reaction temperatures and molar ratios are as described for the above reaction of the compound of the General Formula III with the compound of the General Formula IV with the compound of the General Formula VII being present in an at least equimolar to excess amount as described above for the compound of the General Formula IV. The reaction is preferably conducted in the absence of a solvent but a solvent can be suitably employed, if desired.

In the above-described reactions, known condensing agents can be used as the condensing agent and are generally present in an amount of about 1 to 2 moles per mole of the compound of the General Formula IV and the General Formula VII. For example, aluminum chloride, zinc chloride, acetic anhydride, concentrated sulfuric acid and the like are useful. The compound of General Formula I and the compound of General Formula II are isomers of each other. In the above-described reactions, the compound of General Formula II is produced in a slight amount as a by-product (see, Annalen, vol. 488, p. 259 (1931). These two compounds can easily be separated from each other by, e.g., column chromatography.

Representative examples of compounds represented by the General Formula III, are benzothiophene-2,3-dicarboxylic acid anhydride, 5-methyl-benzothiophene-2,3-dicarboxylic acid anhydride, 5-ethyl-benzothiophene-2,3-dicarboxylic acid anhydride, 5-chlorobenzothiophene-2,3-dicarboxylic acid anhydride, 5-bromobenzothiophene-2,3-dicarboxylic acid anhydride, 4-methyl-6-chlorobenzothiophene-2,3-dicarboxylic acid anhydride, 5-nitrobenzothiophene-2,3-dicarboxylic acid anhydride, 5-aminobenzothiophene-2,3-dicarboxylic acid anhydride, 5-N,N-dimethylaminobenzothiophene-2,3-dicarboxylic acid anhydride, 5-N-acetylaminobenzothiophene-2,3-dicarboxylic acid anhydride, 5-N-benzoylaminobenzothiophene-2,3-dicarboxylic acid anhydride, 5-morpholinobenzothiophene-2,3-dicarboxylic acid anhydride, 5-piperidinobenzothiophene-2,3-dicarboxylic acid anhydride, 5-N,N-di-benzylaminobenzothiophene-2,3-dicarboxylic acid anhydride, 6-methoxybenzothiophene-2,3-dicarboxylic acid anhydride, 6-ethoxybenzothiphene-2,3-dicarboxylic acid anhydride, 6-acetoxybenzothiophene-2,3-dicarboxylic acid anhydride, 5-acetylbenzothiophene-2,3-dicarboxylic acid anhydride, 4,5,6,7-tetrachlorobenzothiophene-2,3-dicarboxylic acid anhydride, 5,7-dimethylbenzothiophene-2,3-dicarboxylic acid anhydride, and the like.

Representative examples of compounds represented by the General Formula IV, are aniline, N-methylaniline, N-ethylaniline, o-toluidine, m-nitroaniline, m-phenylenediamine, m-chloroaniline, m-bromoaniline, o-anisidine, o-phenetidine, 2,5-dichloroaniline, N,N-dimethylaniline, N,N-diethylaniline, N-2-ethylhexyl-N-methylaniline, N,N-dibutylaniline, N-dodecyl-N-ethylaniline, N,N-diethyl-m-toluidine, N,N-diethyl-o-toluidine, N,N-dibenzylaniline, N-methyl-N-benzylaniline, N-ethyl-N-benzylaniline, diphenylamine, N-benzyldiphenylamine, 4-benzyloxydiphenylamine, N-ethyl-4-ethoxydiphenylamine, N-methyldiphenylamine, N-ethyldiphenylamine, N,N-diethyl-o-anisidine, N,N-dimethyl-o-phenetidine, N,N-diethyl-m-acetoxyaniline, N,N-dimethyl-m-nitroaniline, N,N-diethyl-m-nitroaniline, N,N-dimethyl-o-chloroaniline, N,N-dimethyl-m-chloroaniline, N,N-diethyl-m-chloroaniline, N,N-dimethyl-o-bromoaniline, N,N-dimethyl-m-bromoaniline, N,N-diethyl-o-bromoaniline, N,N-diethyl-m-bromoaniline, N,N-diethyl-m-phenethyloxyaniline, N,N-bis($\beta$-cyanoethyl)aniline, N,N-bis($\beta$-chloroethyl)aniline, N,N-bis($\beta$-bromoethyl)aniline, N,N-bis($\beta$-ethoxyethyl)aniline, N,N-bis($\beta$-cyanoethyl)-m-toluidine, N,N-bis($\beta$-chloroethyl)-m-toluidine, N,N-bis($\beta$-bromoethyl)-motoluidine, N-ethyl-N-($\beta$-chloroethyl)-m-toluidine, N,N-bis($\beta$-ethoxyethyl)-m-toluidine, N-ethyl-N-phenethylaniline, N-ethoxycarbonylmethyl-N-cyclohexylaniline, acetanilide, benzanilide, N-ethyl-N-phenacylaniline, N,N-diethyl-m-phenylenediamine, N,N-diethyl-o-phenylenediamine, N,N,N',N'-tetraethyl-m-phenylenediamine, N,N,N',N'-tetraethyl-o-phenylenediamine, N-cyclohexyl-N-methylaniline, N-phenylmorpholine, N-phenylpiperidine, N-phenylpyrrolidine, N-phenylimidazoline, N-phenylpyrazolidine, N-phenylpiperadine, julolidine, and the like.

Representative examples of compounds represented by the General Formula VII are 1-naphthylamine, N,N-dimethyl-1-naphthylamine, N,N-diethyl-1-naphthylamine, 5-chloro-N,N-dimethyl-1-naphthylamine, 5-bromo-N,N-dimethyl-1-naphthylamine, 5-ethoxy-N,N-diethyl-1-naphthylamine, 5-benzyloxy-N,N-dimethyl-1-naphthylamine, N-ethyl-N-benzyl-1-naphthylamine, N,N-bis-$\beta$-chloroethyl-1-naphthylamine, N,N-bis-$\beta$-bromoethyl-1-naphthylamine, N,N-bis-$\beta$-cyanoethyl-1-naphthylamine, N,N-bis-$\beta$-methoxyethyl-1-naphthylamine, N,N-bis-$\beta$-ethoxyethyl-1-naphthylamine, N-phenyl-N-methyl-1-naphthylamine, and the like, as well as those illustrated by the compounds represented by the General Formula IV.

The color former to be used in the present invention is colored blue to bluish green to green. However, it can be colored various hues by combining it with other color formers. To partly illustrate such other color formers, there are triarylmethane compounds (e.g., 3,3-bis(p-dimethylaminophenyl)-6-dimethylaminophthalide (i.e., Crystal Violet lactone (hereinafter abbreviated as CVL) ), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)-phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.), diphenylmethane compounds (e.g., 4,4-bis-dimethylaminobenzhydrin benzyl ether, N-halophenyl leucoauramine, N-2,4,5-trichlorophenyl leucoauramine, etc.), canthene compounds (e.g., rhodamine B anilinolactam, rhodamine (p-nitroanilino)lactam, rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino) 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran, 7 -diethylamino-3-(diethylamino)fluoran, etc.), thiazine compounds (e.g., benzoyl leucomethylene blue, p-nitrobenzyl leucomethylene blue, etc.), and spiro compounds (e.g. 3-methyl-spiro-dinaphthopyran, 3,3'-dichloro-spiro-dinaphthopyran, 3-benzylspiro-dinaphthopyran 3-methyl-naphtho-(3-methoxybenzo)-spiropyran, 3-propyl-spiro-dibenzopyran, etc.). In addition, yellow, red or blue color formers described in Japanese Pat. Publication Nos. 4698/70, 22650/71, 23513/71, 2529/71, 25657/70, 4662/72, U.S. Pat. Nos. 2,417,897, 2,909,520, etc. can also be used in combination.

On the other hand, with the color developers which have already been described before, e.g., the clay minerals such as acid clay, activated clay, attapulgite, zeolite, bentonite, kaolin, etc., organic acids such as succinic acid, tannic acid, gallic acid, phenolic compounds, etc., or acidic polymers such as phenol formaldehyde resins as disclosed in U.S. Pat. Nos. 2,505,470, 2,505,471, 2,505,489, 2,548,366, 2,712,507, 2,730,456, 2,730,457, 3,418,250, 3,501,331, 3,669,711, 3,427,180, 3,455,721, 3,516,845, 3,634,121, 3,672,935, and 3,732,120, they are applied to a support together with a binder (e.g., styrene butadiene latex, starch, casein, gum arabic, polyvinyl alcohol, styrene-maleic anhydride copolymer, etc.). The color developer layer can be provided on a support different from or the same as that of the color former. In the latter case, the color developer layer can be provided on the side opposite to or the same as that of the color former layer. In addition, the color former layer and the color developer layer can be provided either all over or only on a part of the support.

The thienofuran derivatives used in the present invention can form color extremely rapidly with a high color density when brought into contact with a color developer. After color formation, they show excellent properties in light resistance, heat resistance, etc. suitable for pressure-sensitive copying papers.

In addition, when the amino groups represented by $R_1$ and $R_2$ contain substituents having weak electron-attracting property, i.e., when a lower alkyl group (e.g., having 1 to 4 carbon atoms) or the like is used as the amino group substituent, the color formers can be colored so easily that it is colored merely when absorbed on the fibers of paper which has no such color developer as clays, organic acids, phenols, phenol resins, etc. A pressure-sensitive paper which requires no color developer can be prepared utilizing this property.

The following examples are given to illustrate the invention in greater detail. Unless otherwise indicated all parts, percents, ratios and the like are by weight.

EXAMPLE 1

40 ml of ethylene dichloride was added as a solvent to a mixture of 7 g of diethylaniline and 7 g of aluminum chloride. Then, 3 g of benzothiophenedicarboxylic acid anhydride was added thereto and heated for 4 hours under stirring using a steam bath. Thereafter, 30 ml of acetic anhydride was added thereto and heating was continued for an additional 2 hours under stirring. After allowing to cool, the reaction mixture was poured into ice-water and, after adjusting the pH of the mixture so that it was slightly alkaline using a dilute sodium hydroxide solution, it was extracted with benzene. After removing moisture, the extract was concentrated and subjected to column chromatography on silica gel to separate the isomers from each other. Thus, there were obtained 20 g of 1,3-dihydro-1-oxo-3,3-bis(p-diethylaminophenyl)benzo-[b]thieno[2,3-C]furan (m.p.: 167°–168°C; $\lambda_{max}$: 650 m$\mu$ (in 95% acetic acid) ) and 0.2 g of 1,3-dihydro-3-oxo-1,1-bis(p-diethylaminophenyl)benzo[b]thieno[2,3-C]furan (m.p.: 171°–172°C; $\lambda_{max}$: 670 m$\mu$ (in 95% acetic acid) ).

These compounds were colorless or lightly colored crystals or resinous powders and, when dissolved in acetic acid, they showed a maximum absorption in the visual area at a wavelength of 600–700 m$\mu$ and appeared blue, bluish green or green. The compounds were confirmed using infrared spectral analysis, mass spectral analysis and elemental analysis.

EXAMPLE 2

One part of a mixture of 1,3-dihydro-1-oxo-3,3-bis(p-diethylaminophenyl)benzo[b]thieno[2,3-C]furan (color former No. 1) and a smaller amount of 1,3-dihydro-3-oxo-1,1-bis(p-diethylaminophenyl)benzo[b]thieno[2,3-C]furan was dissolved in 30 parts of an alkylated naphthalene, amyl naphthalene. This solution was added to 50 parts of water containing dissolved therein 6 parts of gelatin and 4 parts of gum arabic under vigorous stirring to emulsify and form oil droplets of a diameter of 1 $\mu$ – 10 $\mu$ followed by adding thereto 250 parts of water. Then, acetic acid was added thereto incrementally to adjust the pH of the solution to about 5 to cause coacervation, thus forming a capsule wall of gelatin and gum arabic around the oil droplets. Thereafter, 1.5 parts of a 31% by weight aqueous formaldehyde solution was added thereto and the pH was increased to 9 to thereby harden the capsule wall.

The thus obtained microcapsule dispersion was applied to a paper so as to provide 5 g/m$^2$ of the paper and dried. When a localized pressure or impact was applied to the resulting paper in contact with a paper coated with acidic clays, phenols, organic acids or the like, a green image was immediately obtained. The resulting image had high color density andd was excellent in light resistance, heat resistance and water resistance.

EXAMPLE 3

In the same manner as described in Example 2 except for using the following compounds in place of 1,3-dihydro-1-oxo-3,3-bis(p-diethylaminophenyl)-benzo[b]-thieno[2,3-C]furan and 1,3-dihydro-3-oxo-1,1-bis(p-diethylaminophenyl)benzo[b]thieno[2,3-C]furan, a pressure-sensitive copying paper excellent in light resistance and heat resistance and capable of being colored rapidly with high color density was obtained, in every case.

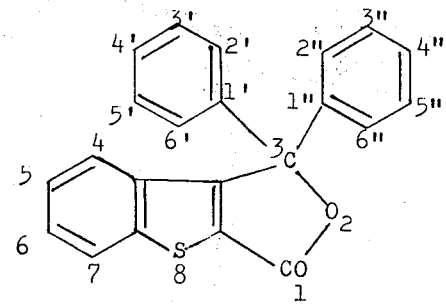

(A)

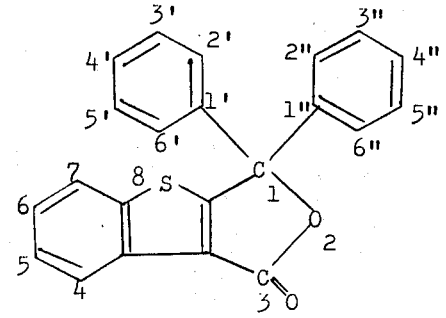

(B)

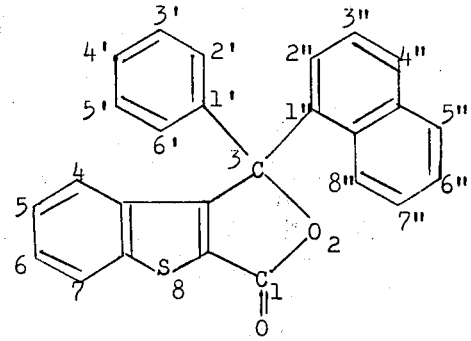

(C)

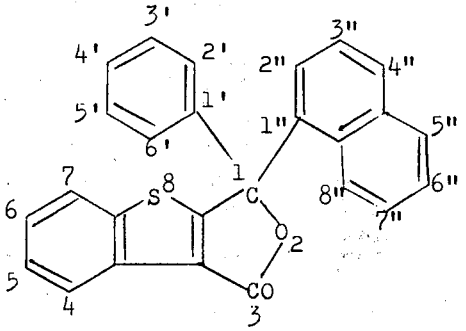

(D)

With color formers No. 1 to No. 32, the positions of substituents are indicated according to (A) and (B) and, with color formers No. 33 to No. 42, according to (C) and (D).

| Color Former No. | Ring A | $R_1$ | $R_2$ | X | Y | Z | Hue |
|---|---|---|---|---|---|---|---|
| 2 | Benzene | N-N-Di methyl-amino | N,N-Di methyl-amino | H | H | H | Green |
| 3 | " | " | N-Ethyl-N-Benzyl-amino | " | " | " | Bluish-green |
| 4 | " | " | N-Methyl-N-benzyl-amino | " | " | " | Bluish-green |
| 5 | " | N-N-Di-ethyl amino | N,N-Di-benzyl-amino | " | " | " | Bluish-green |
| 6 | " | " | N-Methyl-N-phenyl-amino | 2'-Methyl | " | " | Bluish-green |
| 7 | " | N-Methyl-N-Phenyl-amino | N-Methyl-N-phenyl-amino | H | " | 5-Methyl | Greenish-blue |
| 8 | " | N-N-Di-ethyl-amino | N,N-Di-ethyl-amino | 2'-Methyl | 2''-Methyl | " | Green |
| 9 | " | " | " | 3'-Methyl | 3''-Methyl | 5-ethyl | Green |
| 10 | " | " | " | 2'-Methoxy | 2''-Meth-oxy | " | Green |
| 11 | " | N,N-Di-methyl-amino | N,N-Di-methyl-amino | 2'-Bromo | 2''-Bromo | H | Green |
| 12 | " | N,N-Di-ethyl-amino | N-Ethyl N-phe-thyl-amino | H | H | " | Bluish-green |
| 13 | " | " | N-Ethyl-N-phenyl-amino | " | " | 5-Methyl | Bluish-green |
| 14 | " | N-Ethyl-N-benzyl-amino | N-Ethyl-N-benzyl-amino | " | 2''-Ethoxy | " | Greenish-blue |
| 15 | " | N,N-Di-benzyl-amino | N,N-Di-benzyl-amino | " | H | " | Greenish-blue |
| 16 | " | N,N-Bis-(β-ethoxy-ethyl)-amino | N,N-Bis-(β-ethoxy-ethyl)-amino | 2' Methyl | 2'' Methyl | 5-Nitro | Green |
| 17 | " | N,N-Bis-(β-cyano-ethyl)-amino | N,N-Bis-(β-cyano-ethyl)-amino | " | " | 5-Methyl | Green |
| 18 | " | N,N-Bis-(β-bromo-ethyl)-amino | N,N-Bis-(β-bromo-ethyl)-amino | " | " | 5-Bromo | Green |
| 19 | " | Mor-pholino | Mor-pholino | H | H | 5-Chloro | Green |
| 20 | " | N,N-Di-methyl-amino | N,N-Di-methyl-amino | " | " | " | Green |
| 21 | " | N-Cyclo-hexyl-N-methyl-amino | N-Cyclo-hexyl-N-methyl-amino | 2'-Nitro | 2''-Nitro | " | Green |
| 22 | " | Piperi-dino | Piperi-dino | H | H | 5-Bromo | Green |
| 23 | " | N,N-Di-ethy-amino | N,N-Di-ethyl-amino | 2'-Di-ethyl-amino | 2''-Di-ethyl-amino | 5-Bromo | Green |
| 24 | " | N-Methyl-N-Phena-cylamino | N-Methyl-N-phena-cylamino | H | H | 5-Chloro | Greenish-blue |
| 25 | " | N,N-Di-ethyl-amino | N,N-Di-ethyl-amino | 3'-Methyl | 2''-Ace-toxy | 6-Ethoxy | Green |
| 26 | " | " | " | 2'-Chloro | 2''-Chloro | " | Green |
| 27 | " | N,N-Di-methyl-amino | N,N-Di-methyl-amino | 2'-Acet-oxy | 2''-Acet-oxy | 5-Methyl-6-chloro | Green |
| 28 | " | N-Methyl-N-phena-cylamino | N-Methyl-N-phena-cylamino | H | H | " | Greenish-blue |
| 29 | " | N,N-Di-ethyl-amino | N,N-Di-benzyl-amino | 2'-Methyl | " | " | Bluish-green |

-continued

| Color Former No. | Ring A | $R_1$ | $R_2$ | X | Y | Z | Hue |
|---|---|---|---|---|---|---|---|
| 30 | " | " | N,N-Diethylamino | 2'-Methyl | 2''-Methyl | 5-Dimethylamino | Green |
| 31 | " | N-Phenylamino | N-Phenylamino | H | H | 5-Amino | Blue |
| 32 | " | N-Benzylamino | N-Benzylamino | 3'-Methyl | 3''-Methyl | " | Blue |
| 33 | Naphthalene | N,N-Dimethylamino | N,N-Dimethylamino | H | H | H | Blue |
| 34 | " | N,N-Diethylamino | N,N-Diethylamino | " | " | " | Blue |
| 35 | " | N-Methyl-N-phenylamino | N,N-Dimethylamino | " | 8-chloro | " | Blue |
| 36 | " | N,N-Diethylamino | N,N-Dimethylamino | 2'-Methyl | H | 5-Methyl | Blue |
| 37 | " | N-Methyl-N-Phenylamino | " | 3'-Methyl | " | " | Blue |
| 38 | " | N,N-Diethylamino | " | 2'-Methyl | " | 5-Acetylamino | Blue |
| 39 | " | N,N-Dimethylamino | N-Ethyl-N-benzylamino | " | " | 5-Benzoylamino | Blue |
| 40 | " | N,N-Dimethylamino | Amino | 2'-Chloro | " | 4-Methyl-6-chloro | Dark Blue |
| 41 | " | N,N-Diethylamino | Amino | H | 8''-Chloro | 5-Chloro | Dark Blue |
| 42 | " | " | N,N-Dimethylamino | 2'-Bromo | 8''-Bromo | 6-Ethoxy | Blue |
| 43 | " | N,N-Dibutylamino | " | H | H | 5-Benzyloxy | Blue |

EXAMPLE 4

0.6 parts of 1,3-dihydro-1-oxo-3,3-bis(p-diethylaminophenyl)-benzo[b]thieno[2,3-C]furan, 0.3 part of 3-diethylamino-5,7-dimethylfluoran as described in Japanese Pat. Publication No. 2529/71 and 0.3 part of 3,6-dimethoxyfluoran as described in Japanese Pat. Publication No. 4698/70 were dissolved in 30 parts of an alkylnaphthalene, anylnaphthalene. This solution was added, under vigorous stirring, to an aqueous solution prepared by dissolving 6 parts of gelatin and 4 parts of gum arabic in 50 parts of water to form an o/w emulsion (oil droplet size: 1 $\mu$ – 10 $\mu$). To this o/w emulsion was added 250 parts of water and, after adjusting the pH to 4 with acetic acid, cooled, followed by adding 1.5 parts of a 37% by weight aqueous solution of formaldehyde thereto to harden. The resulting capsule dispersion was applied to a paper (5 g/m$^2$ dry basis) and dried. When a localized pressure or impact was applied to the resulting paper in contact with a receiving paper having coated thereon a color developer, it was colored black. The thus formed image had a high density and was so excellent in light resistance and heat resistance that its hue changed only slightly.

EXAMPLE 5

The procedures described in Example 4 were repeated using Color Formers No. 2 to No. 42. Thus, pressure-sensitive copying papers were obtained which were immediately colored black. In every case, the resulting image had a high density and a stable hue.

EXAMPLE 6

One part of Color Former No. 7 (a mixture of 1,3-dihydro-1-oxo-3,3-bis(p-N-methyl-N-phenylamino-phenyl)-5-methyl-benzo[b]-thieno[2,3-C]furan and the isomer thereof) was encapsulated in the same manner as described in Example 2. Then, this capsule dispersion was coated on the color developer-coated side of a color developer-coated paper (5 g/m$^2$ dry basis) and dried. The resulting multi-coated paper was immediately colored in greenish blue with high density, at the area to which a localized pressure was applied. With other dyes given in the foregoing table, the same results were obtained.

EXAMPLE 7

Color Former No. 2 (a mixture of 1,3-dihydro-1-oxo-3,3-bis(p-dimethylaminophenyl)-5-chlorobenzo[b]-thieno[2,3-C]furan and the isomer thereof) was encapsulated in the same manner as described in Example 2, and applied to a paper (4 g/m$^2$ dry basis) followed by drying. When the resulting paper was superposed on an ordinary paper (paper having no color developer coated thereon) and a localized pressure was applied to the assembly, the pressure-applied area was colored green to form a printed image. That is, a pressure-sensitive copying paper was obtained which required no color developer such as clays or phenols and was colored merely by absorbing the color former onto the fibers of the receiving paper.

EXAMPLE 8

The procedures described in Example 7 were conducted except for using Color Former No. 1, 2, 8, 9, 10, 11, 12, 16, 17, 18, 19, 20, 21, 23, 25, 26, 27, or 30 in place of Color Former No. 20. Thus, similar to Example 7, pressure-sensitive papers which did not necessarily require a color developer were obtained. The hues of the colors formed were substantially the same as shown in the foregoing table.

EXAMPLE 9

The procedures described in Example 6 were repeated using 1 part of Color Former (No. 1), 1 part of 3-diethylamino-7-acetylaminofluoran and 1.5 parts of 3,6-diethoxyfluoran. Thus, a black colored image was obtained.

EXAMPLE 10

The procedures described in Example 6 were repeated using 1 part of Color Former (No. 5), 0.5 part of 3-diethylamino-7,8-benzofluoran and 2 parts of 3,3-bis(4-dimethylaminophenyl)-6-dimethylamino-phenylphthalide. Thus, bluish black colored image was obtained.

While the invention has been described in detail and with reference to specific embodiments thereof, it will be apparent to one skilled in the art that various changes and modifications can be made therein without departing from the spirit and scope thereof.

What is claimed is:

1. A pressure-sensitive copying paper system which comprises a support having thereon a color former layer containing a 1,3-dihydro-1-oxo-benzo[b]-thieno[2,3-C]furan derivative represented by the following General Formula I:

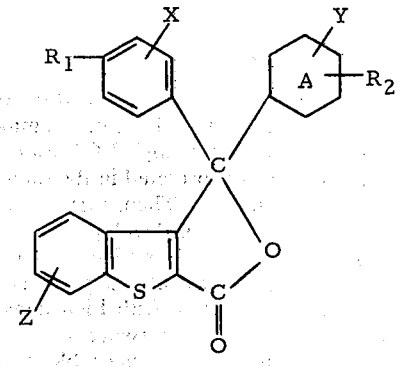

(I)

or a 1,3-dihydro-3-oxo-benzo[b]thieno[2,3-C]furan derivative represented by the following General Formula II:

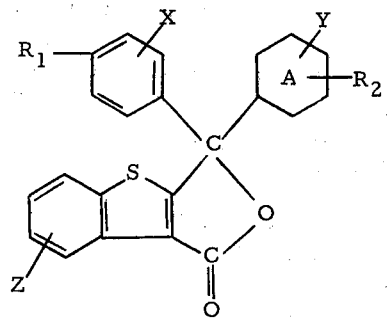

(II)

wherein ring A represents a benzene ring or a naphthalene ring, $R_1$ and $R_2$ each represents an amino group, and X, Y and Z each represents a hydrogen atom, a halogen atom, an alkyl group, an aralkyl group, an alkoxy group, an aralkoxy group, an acyloxy group, a nitro group or an amino group and a color developer layer for said color former on the same or opposite side of said support, or on a different support.

2. The pressure-sensitive copying paper of claim 1, wherein said amino group for $R_1$ and $R_2$ is an unsubstituted amino group or a substituted amino grup having as substituents an alkyl group, an aralkyl group, an aryl group, an acyl group, an alicyclic group or a heterocyclic group, wherein said halogen atom for X, Y and Z is a chlorine atom, a bromine atom or an iodine atom, said alkyl group for X, Y and Z has 1 to 4 carbon atoms, said aralkyl group for X, Y and Z has 1 to 4 carbon atoms in the alkyl moiety thereof and the aryl moiety thereof is a phenyl group or a naphthyl group, said alkoxy group for X, Y and Z has 1 to 4 carbon atoms in the alkyl moiety thereof, said aralkoxy group for X, Y and Z has 1 to 4 carbon atoms in the alkyl moiety thereof and the aryl moiety thereof is a phenyl group or a naphthyl group, said acyloxy group for X, Y and Z is an aliphatic acyloxy group or an aromatic acyloxy group and wherein said amino group for X, Y and Z is an unsubstituted amino group or a substituted amino group having substituents as defined for $R_1$ and $R_2$.

3. The pressure-sensitive copying paper of claim 2, wherein said amino group for $R_1$ and $R_2$ is an amino group substituted with a methyl group, an ethyl group, a propyl group, a butyl group, a chloromethyl group, a chloroethyl group, a bromomethyl group, a bromoethyl group, an iodomethyl group, an iodoethyl group, a cyanomethyl group, a cyanoethyl group, a cyanopropyl group, a cyanobutyl group, a methoxyethyl group, an ethoxyethyl group, a benzyl group, a chlorobenzyl group, a bromobenzyl group, a methylbenzyl group, an ethylbenzyl group, a phenethyl group, a chlorophenethyl group, a bromophenethyl group, a methylphenethyl group, an ethylphenethyl group, a phenyl group, a chlorophenyl group, a bromophenyl group, a tolyl group, an ethylphenyl group, a naphthyl group, a chloronaphthyl group, a bromonaphthyl group, a methylnaphthyl group, an ethylnaphthyl group, an acetyl group, a benzoyl group, a phenacyl group, a cyclohexyl group, a morpholino group, a piperidino group or a julolidino group.

4. The pressure-sensitive copying paper of claim 1, wherein said color former layer comprises microcapsules containing said compound of the General Formula I, the General Formula II, or mixture thereof.

5. The pressure-sensitive copying paper of claim 1, wherein said support is a paper, a plastic sheet, or a resin-coated paper.

6. The pressure-sensitive copying paper of claim 1, wherein said color former layer additionally contains a color former selected from the group consisting of a triarylmethane compound, a diphenylmethane compound, a xanthane compound, a thiazine compound, a spiro compound and a mixture thereof.

* * * * *